United States Patent [19]

Hoffmann et al.

[11] 4,311,002

[45] Jan. 19, 1982

[54] FORMING STRANDED STOCK

[75] Inventors: Ernst Hoffmann; Friedrich Schatz, both of Langenhagen; Artur Unger, Lennep, all of Fed. Rep. of Germany

[73] Assignee: Kabel-und Metallwerke Gutehoffnungshutte AG, Hanover, Fed. Rep. of Germany

[21] Appl. No.: 182,492

[22] Filed: Aug. 29, 1980

Related U.S. Application Data

[63] Continuation-in-part of Ser. No. 944,582, Sep. 21, 1978, abandoned.

[30] Foreign Application Priority Data

Sep. 22, 1977 [DE] Fed. Rep. of Germany ..... 2742662
Oct. 24, 1979 [DE] Fed. Rep. of Germany ..... 2942924

[51] Int. Cl.[3] ..... H01B 13/04
[52] U.S. Cl. ..... 57/293; 57/294
[58] Field of Search ..... 57/293, 294

[56] References Cited

U.S. PATENT DOCUMENTS 3,025,656 3/1962 Cook ..... 57/293
3,052,079 9/1962 Henning ..... 57/293
3,169,360 2/1965 Corrall et al. ..... 57/294
3,426,519 2/1969 Unger et al. ..... 57/294 X
3,481,127 12/1969 Vogelsberg ..... 57/294
3,491,525 1/1970 Sugi ..... 57/294
3,855,777 12/1974 Durkee et al. ..... 57/293 X
4,012,894 3/1977 Akachi et al. ..... 57/293
4,056,925 11/1977 Vogelsberg ..... 57/293

FOREIGN PATENT DOCUMENTS 2514033 10/1976 Fed. Rep. of Germany .

*Primary Examiner*—John Petrakes
*Attorney, Agent, or Firm*—Smyth, Pavitt, Siegemund & Martella

[57] ABSTRACT

Plural strands, e.g., conductors, having a particular cross section, are drawn off spools, run through straightening rolls, and are combined in a bundle in a first stranding point. Brackets on a caterpillar-like capstan grip the bundle and hold it while turning the bundle on the stranding axis. The bundle continues towards a second stranding point spaced particularly from the capstan. The stationary (nonrevolving) stranding points can be established by nipples or by additional, nonrevolving capstans, in which case slidable brackets are used to compensate speed differentials. The revolving capstan may rotate continuously or reverse periodically to obtain different types of stranding patterns.

23 Claims, 6 Drawing Figures

$2l_{sp} \leq l$

FORMING STRANDED STOCK

This application is a continuation-in-part of application Ser. No. 944,582, filed Sept. 21, 1978, now abandoned.

BACKGROUND OF THE INVENTION

The present invention relates to continuously stranding elongated stock such as conductors, etc., particularly of the variety having larger cross-section and/or complex profiles in cross-section, to obtain a stranded cable, rope or the like.

Equipment for stranding elongated stock, particularly of the heavy variety, uses storage drums or spools from which the stock is continuously paid, and these drums or spools are mounted on a rotating device. The individual strands of stock are run together at a stranding point and stranded. If the strands themselves are stranded filaments or the like, a higher order stranding element is produced.

It is inevitable that the known stranding machines require movement of heavy components which limits the production speed. Furthermore, the known equipment requires an inordinate amount of space while the storage capacity for the stock being stranded together is quite limited. These features, in turn, limit the length of the product being made. A typical stranding device is shown, e.g. in U.S. Pat. No. 3,106,815.

The aforementioned drawbacks have been attempted to be alleviated by means of stranding the stock with reversing pitch. Each strand is guided by particular means which reverse rotation (see German printed patent application No. 25 14 033). The resulting equipment is indeed more economical and requires less space, and less consideration can be given to inertia forces resulting from rotation. Also, set up and preparation times are considerably reduced.

The known equipment as referred to in the preceding paragraph are disadvantaged by torsion forces in strands of larger cross-section. If the strands are insulated, the insulation may be damaged. In the case of cable, damage to the insulation cannot be tolerated.

DESCRIPTION OF THE INVENTION

It is an object of the present invention to strand elongated stock to obtain a stranded configuration, such as a cable, a rope or the like, which is free from the deficiencies outlined above and wherein particularly the strands are not damaged in the process.

It is another object of the present invention to obtain a stranded product on a continuous basis and with little expenditure in machinery and operating personnel.

In accordance with the preferred embodiment of the invention, it is suggested to withdraw the strands from individual, reelable, but otherwise stationary mounted spools and, preferably, to straighten the strands before twisting them together. The straightening may include orienting the strands to each other, if they are particularly contoured and should be assembled in contour matching configuration. The strands are combined in a bundle; the combining head may constitute a first stranding point. Downstream from that stranding point, the bundle is gripped and held on an axis for a certain length or a particular travel path while the means for gripping and holding revolve about a stranding axis; upon release, the twisted bundle is run through a non-revolving second stranding point. The term "stranding point" is to mean a point passed through by a bundle, and on one side a revolving (twisting) motion is imparted upon the bundle while no such motion is imparted upon the bundle on the other side of that point.

The means for gripping and holding will preferably include plural brackets which grip and clamp the bundle in pairs, hold it positively for a certain length of common travel and release it thereafter, but all the while revolving about the stranding axis. The brackets, or bracket elements, may be mounted on two endless belt-like carriers constructed in caterpillar fashion and each carrying the spaced brackets. These brackets cooperate in pairs, one per carrier of each pair, to hold and grip the bundle, whereby the brackets of each pair close on the bundle as it arrives, hold it without twisting, and carry it along for the storage length, and release it as the brackets return. Positive gripping of the bundle avoids damage to the surface of the strands.

In a preferred form, the bracket elements are mounted on endless chains and are configured to function in pairs in a gearlike fashion. One bracket element of a pair has a detent, the other one carries an elastic pin which is received by the detents of the other element as long as they run together in a common path into which the bundle is fed and is being held by the pin and against the detent.

These carriers (such as endless chains) and the brackets thereof constitute a capstan being preferably mounted in a frame and rotating about the stranding axis. Depending upon the type of stranding required, the frame, i.e., the means for gripping and holding, may rotate continuously, resulting in a continuous mode of helically looping the strands about each other and the common stranding axis. In other cases, it is desirable to more or less frequently reverse the rotation and to reverse the pitch, after less than one twisting turn or several thereof. This way, one obtains different types of stranding patterns, such as a so-called meander pattern, or an S-Z pattern. For reasons below —and considering S-Z stranding—the second stranding point is to be spaced from the means for gripping and holding by a distance which is an even-numbered multiple of the length of the bundle in between twist reversals which may coincide with the length the bundle is held. The revolving speed may differ in the two directions resulting in different pitch values. Also, the number of unidirectional turns or, more generally, the total angular displacement of the revolving capstan in between reversals may be different in the two directions.

The bundling of the strands can be separated from the first stranding point by means of another capstan which grips and holds the bundle for a certain length but does not rotate. Upon adjusting and synchronizing the capstans, particularly as far as opening and closing of brackets is concerned, the length of the bundle between the capstans in any instant can be made constant. Analogously, the second stranding point downstream from the revolving capstan can be established by another capstan. The spacings between the capstans may be varied to change the lay and pitch of twisting. However, the rule concerning spacing between the second stranding point and the end of the revolving capstan should be observed (even multiple of the travel length between reversals). The purpose thereof is, briefly, the following. In the case of so-called S-Z stranding, it was observed that the stranded bundle has a certain waviness. That deficiency is of no consequence operationally, for example in the case of a cable; but the cable has a rather odd, unpleasant appearance and may be difficult to handle. Appearance and ease of handling are improved if the spacing between the revolving capstan and the second stranding point is an even-numbered multiple of the travel path length for the bundle in between reversals.

If three such capstans are disposed in series, only the middle one revolving, the propagation speed of the stock from capstan to capstan reduces in downstream direction. All three capstans should be driven at the same constant speed for reasons of ensuring the requisite synchronization. The brackets should be mounted on the carriers to permit additional longitudinal movement during the time of engagement with the stock to compensate the above-mentioned speed differential of the stock.

Downstream from the second stranding point, one may wrap a ribbon or the like around the cable for preventing untwisting. However, upon holding and stranding the twisted stock, e.g. by a downstream, non-revolving capstan, such wrapping may not be needed. Additionally or alternatively, a second lay may be stranded on top of the stock after leaving the device described above.

As far as further improvement is concerned, it was found advisable to jacket the bundle already upstream from the second stranding point, downstream from the revolving capstan. Jacketing may include extruding a layer and filling the gaps between the stranded elements, and it may further include wrapping a ribbon around the bundle, possibly prior to extrusion. Also, the bundle may be marked at that point in a suitable fashion.

Stranding may be carried out in steps in that a second revolving capstan is provided downstream from the first revolving one, but rotating in opposite direction. This way, the lay (pitch) is doubled. If the two capstans revolve uniformly, the path between them serves as temporary storage.

In special cases, it may be desirable to open and reclose the brackets; during the open period they change their azimuthal position relative to the bundle. The brackets, therefore, will exert torsion upon the bundle for twisting it intermittently only which results in a non-uniform speed of stranding.

The preferred embodiment of the invention, the objects and features of the invention, and further objects, features and advantages thereof, will be better understood from the following description taken in connection with the accompanying drawings.

DESCRIPTION OF THE DRAWINGS

Proceeding now to the detailed description of the drawings, FIG. 1 illustrates several drums or spools 2, journalled for rotation about their own axis, but being otherwise stationarily mounted in a plant or the like. Individual strands 1 are taken from these drums or spools and pass through sets of straightening rollers 3. The straightened and, possibly, oriented strands 1 are fed to a stranding head or nipple 4 which, in the essence, combines the strands in a bundle 1*a*. The number of strands to be bundled and stranded is, of course, not limited to three.

Figure 1:
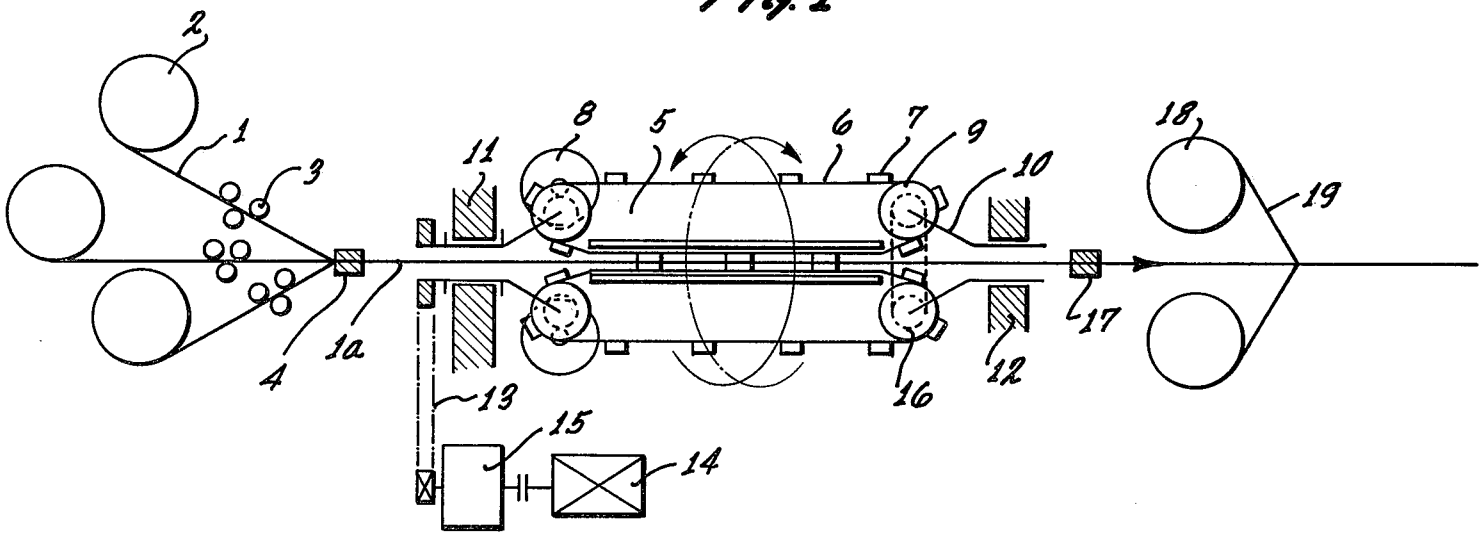
FIG. 1 is a schematic view of an apparatus for stranding stock in accordance with the preferred embodiment of the invention.

The bundle 1*a* is received by the stranding device 5 arranged downstream from nipple or head 4. The device 5 is essentially constructed as a capstan being comprised of two endless chains 6 carrying clamping jaws or brackets 7, which cooperate in pairs, one jaw or bracket per chain of each pair. The brackets grip the bundle positively in form closed engagement. The chains are driven by drives 8 and synchronized as to speed and phase by a linking belt, sprocket belt 16 or the like. Reference numeral 9 refers to reversing pulleys or sprockets for each chain.

The capstan chains with brackets, drives and reversing rolls 9 are mounted in a frame 10 having hollow shafts which are journalled in bearings 11 and 12, to permit rotation of the frame so that the capstan 5 revolves about the stranding axis. The frame is driven by a motor 14 such as a d.c. four quadrant motor, in that the motor drives a transmission gear 15 which, in turn, drives a belt, sprocket chain or the like, 13.

The motor 14 is a reversible one (or the transmission is constructed for reversing the direction of rotation), reversal being provided by a controller 14*a*, so that the frame and stranding device 5 can rotate in one or the opposite direction as indicated by the two arrows. If stranding is carried out without reversing pitch, a reversibility of the drive is not required. The distance between the capstan and the head 4 may be adjustable to vary the lay, i.e. the number of twists per unit length. The drives 8 could be disposed outside of the frame so that they do not revolve with the capstan proper. A transmission is needed in this case to drive the chains whereby the chain speed is the composite of drive speed and revolving speed.

A second stranding head or nipple 17 is disposed downstream from device 5, behind which a ribbon 19 is helically wrapped around the stranded conductors. A spool 18 from which the ribbon 19 is paid, revolves about the stranding axis thereby rotating about its own axis as the ribbon is paid and wrapped.

The device operates as follows. The strands 1 may be regular solid conductors or stranded conductors to obtain a higher order of stranding. The invention is of particular interest for stranding particularly profiled conductors having, e.g. pie-shaped cross-sections. The conductors may be insulated so that gentle handling of the insulation envelope is required. In either case, the conductors 1 are reeled off the drums or spools 2 and pass through straightening rollers 3. The rollers in each set are staggeredly arranged and they are oriented to straighten the conductors and to orient, for example, each sector in accordance with the position it is to have in the bundle. Straightening is particularly important if the strands have solid and rather large cross-sections. Sector or pie-shaped conductors are notably stiff and require straightening.

The bundle 1*a* results from the combining action by nipple or head 4. The two chains 6 run continuously so that each bracket is moved in a position vis-a-vis another one and together they grip the incoming bundle 1*a*, hold it for a certain distance, whereafter the brackets open. The brackets grip the bundle positively without permitting relative movement between the strands and the bracket elements. The surface area of contact must be chosen to be sufficiently large so that the per unit surface area clamping force is not too high. This aspect is also important for ensuring that only very low torsion forces act on the insulation. It must not be forgotten that stranding does require the exertion of twisting torsion upon the conductors underneath the insulation.

During the period of time in which the stock is held by brackets, the frame 10 rotates about the stranding axis so that each bracket pair closes about the bundle in a disposition which is angularly offset by a particular amount with regard to the disposition the frame had when the preceding bracket pair closed about the bandle. The number of twists as so imparted depends on the dimensions of the apparatus, on the relative speed of stock and the revolving capstan, and on the distance between capstan 5 and head 4. As stated, one may strand the conductors in the so-called ceander pattern, in which each twisting turn covers at the most 360° in between reversals. Reversals after 180° are quite common in other cases. Less frequent reversals result in the so-called S-Z pattern, wherein the conductors are stranded about each other in several helical turns, before the sense of winding and direction of stranding is changed for plural turns in the opposite direction, etc. The pattern actually results by chosing the instants and phases of reversing the capstan revolution.

The brackets hold the conductor bundle immobile in the capstan, except for the movement forced upon the bundle at the point of engagement with the brackets on account of the translatory and revolving movement of the brackets. Therefore, upon being released, but while traveling from the point of release to nipple 17, an additional twist is provided because the bundle upstream is held by a still closed pair of brackets which continues to revolve. One obtains, therefore, a double-twist stranding.

The wrapping device 18 provides the stranded stock with a helical winding for preventing the stranded conductors from untwisting. The stranded and wrapped stock can be processed further downstream, for example, by extruding insulation on and around the assembly or by jacketing the assembly otherwise. Particularly, the stranded stock can be used as a core, about which are twisted further strands.

It should be noted that the effective stranding length is a continuously variable one. A certain length of the bundle 1*a* is twisted in any instant by cooperation of head 4 and a pair of brackets 7. When the two brackets of a pair close about the bundle, they have a particular distance from the nipple 4 and begin to twist the portion of the bundle between brackets and head as a whole, while receding from the nipple on account of the chain movement. The effective stranding length is, therefore, continously lenghtened until the next pair grips the bundle etc. In cases, this variation in effective length may be deemed undesirable.

Figure 2:
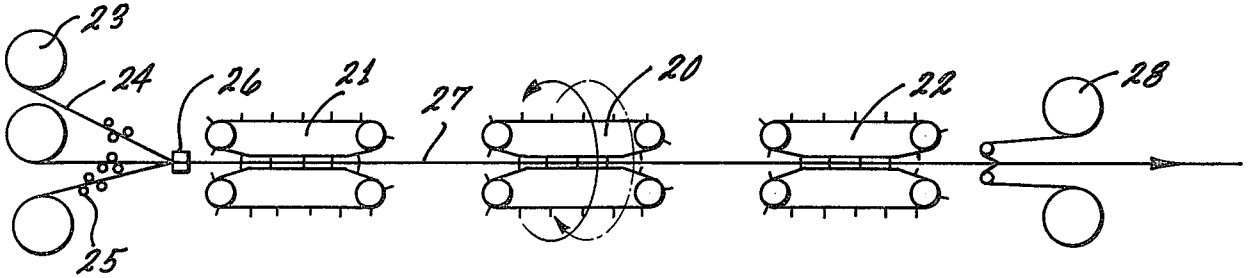
FIG. 2 is a schematic view of a modified and improved device for that purpose.

FIG. 2 illustrates an example in which the effective stranding length remains (or can be made to remain) constant throughout. The equipment includes storage spools 23 for strands 24, sets 25 of straightening rollers and a nipple 26 which, however, does not participate in the stranding action but merely forms a bundle 27. The bundle is gripped by the brackets of a first capstan 21 constructed as the capstan 5 in FIG. 1 but without rotating about the bundle axis. The individual brackets serve as stranding nipples, particularly the downstream most pair of brackets of capstan 21 which is still closed (the one next downstream has already opened) will serve as stranding nipple, holding the bundle azimuthally immobile but feeding a free bundle portion beyond to the stranding capstan.

Reference numeral 20 refers to the stranding capstan assembly being similar to the one identified by numeral 5 in FIG. 1, and including a frame and revolving drive means as described. The two arrows indicate the fact that this capstan 20 revolves about the bundle and stranding axis. The chain drives for the capstans 20 and 21 are synchronized in speed and phase; more about that aspect below. Particularly, a bracket pair of capstan 20 closes on the bundle exactly when a bracket pair of capstan 21 releases the bundle. This way, the length of stock between the last one of brackets on non-revolving capstan 21, being the stranding nipple and holding the stock, and the first pair of brackets of revolving capstan 20 holding the stock, remains exactly the same even though the brackets participating change.

Another non-revolving capstan 22 is provided downstream from capstan 20, and is synchronized thereto in exactly the same fashion, so that the brackets of capstan 22 serve as downstream stranding nipples. A stationary downstream nipple is not used here; rather the device 28 wraps the stranded stock right after being released from brackets of capstan 22. The capstan 22 operates, in fact, also as a straightening device preventing the stranded stock from untwisting, so that wrapping may not be needed.

The device 22 functions additionally as capstan proper, pulling the stock through the equipment and the individual strands off the storage spools 23, though load relief may be provided for the latter. The capstans 20 and 21 may, in fact, be dragged along by the stock in engagement therewith, though load relief may also be provided here. As long as the brackets close positively around the stock, slippage will not occur, and the brackets open and close in synchronism from capstan to capstan. It may, however, be more advantageous to drive additionally all of the capstans. In that particular case the following aspect has to be observed.

Due to the stranding operation, the effective translatory speed of the stock downstream is reduced from capstan to capstan. This is apparent if one realizes that the twisting amounts to a helical coiling of each individual strand which reduces its effective length in the direction of propagation. Thus, the linear speed of capstan 21 is larger than the linear speed of capstan 20, and the linear speed of the latter is still larger than the linear speed of capstan 22, assuming, of course, that the clamping brackets always positively engage the stock without relative movement. The speed relation is established automatically if the devices 20 and 21 are passive, do not actively drive the stock, but are being drive by it.

It is of advantage, however, to drive all capstans, and for reasons of achieving synchronism, constant uniform speed should be imparted on all of them. Accordingly, compensation of the difference in speed of the stock along the line must be provided for. In particular, one must provide for relative movement between the chain drives of the capstans 20, 21 and their clamping brackets.

Figure 4:
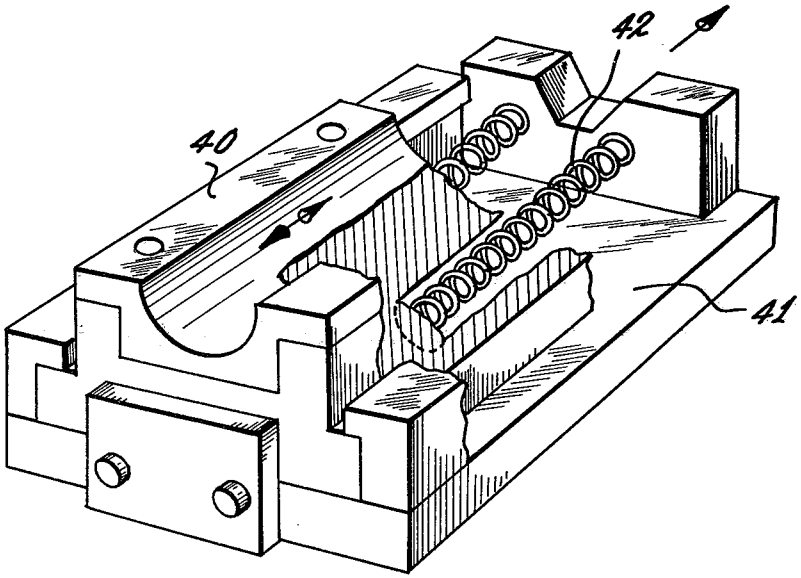
FIG. 4 is a perspective view of clamping elements used in either of the aforementioned examples, preferably in the one shown in FIG. 2.

FIG. 4 illustrates a clamping bracket of the type used on the capstans 20, 21. Each clamping bracket 40 is slidably mounted on a carriage 41. The carriage 41 is secured to an endless chain of the respective capstan, the bracket 40 as positively engaging the bundle or stranded stock, is shifted gradually on the carriage 41. The bracket 40 is spring biased, and the said shifting occurs against the force of the spring 42. The spring returns the bracket on the carriage to the other position upon disengagement from the stock.

The displacement a bracket undergoes is directly proportional to the length of the path a bracket translates in engagement with the stock (and the opposite bracket on the companion chain). The displacement is further proportional to (f-1) wherein f is the stranding factor. Actually, the displacement is the direct product of these two factors. Please note that stranding occurs upstream and downstream from capstan 20.

The displacement of the several brackets, i.e. the force needed to effect the displacement, must be produced by the downstream most capstan. But all capstans are driven so that they all participate in dragging and pulling the stock through the device; the capstan 22 merely provides additionally the displacement forces needed to move all engaging brackets 40 of capstans 20 and 21 against the respective springs.

Figure 3:
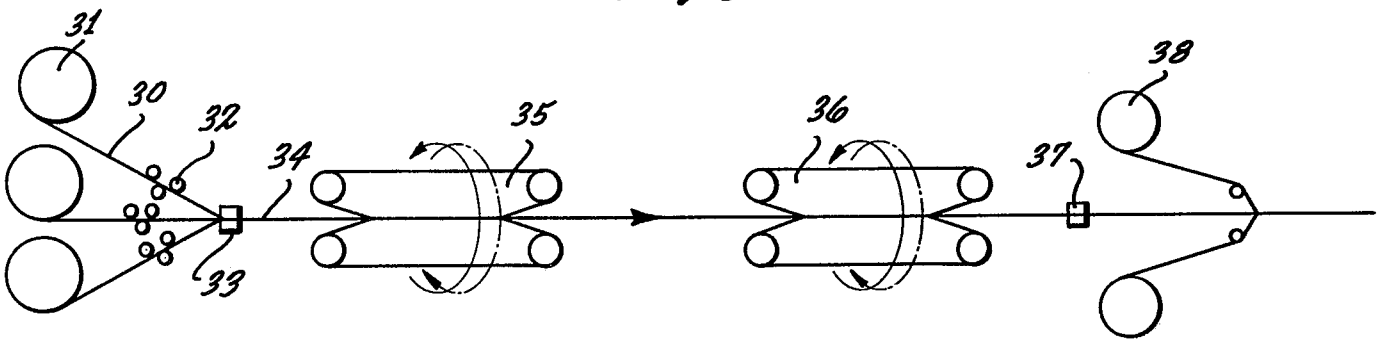
FIG. 3 is a schematic view of a different modification.

FIG. 3 illustrates how the temporary storage capacity of the stranding equipment itself can be increased without interfering with the features outlined above. The elements 30, 31, 32 and 33, respectively, correspond to parts 1, 2, 3 and 4 in FIG. 1, producing a bundle 34 to be stranded downstream from nipple 33. The bundle is gripped by a first revolving capstan 35 constructed and operated like capstan 5 above. Downstream from capstan 35 is provided another revolving capstan 36. Another strand nipple 37 is provided downstream from capstan 36. Stranding is provided between the nipples and the capstans which run in synchronism. Of course, they should also reverse simoultaneously. Reference numeral 38 refers again to a device for wrapping the stranded stock.

This machine, employing two revolving capstans, establishes a variable storage capacity for the stock. The capacity can be varied by varying the distance between the two capstans 35, 36. This feature, in turn, permits the selection of the lays number of the stranding in one direction. The capstan 36 does not have to revolve at the same speed as capstan 35. Moreover, the two capstans 35 and 36 may actually revolve in opposite directions.

A specific improvement will now be explained with reference to FIG. 5 which improvement is basically applicable to all of the serveral examples above. Plural strand elements 50 are paid from a stationary supply (rotating drums); these elements may be of large, e.g., section-shaped cross sections, or each one of the elements 50 may be a conductor composed of stranded filaments, i.e. stranded wire bundels. Guide sheaves or pulleys 52 run these strand elements to a stranding head 53 defining the first stranding point. Rolls or pulleys 52 may also be provided here for stretching and/or straightening of the elements 50 prior to entering the first stranding head.

Head 53 combines the stranding elements in a bundle and feeds them to a stranding device 54 placed downstream from this first stranding point. The stranding device 54 is comprised of two-serial, caterpillar-type capstans 55 and 56, any of which is shown in greater detail in FIG. 6 and will be described more fully below. Suffice it to say that each capstan includes bracket elements which grip the bundle 67, hold if for a certain storage path length and release it again.

As described earlier and quite analogously, each of the capstans 55 and 56 revolve on and about the longitudinal stranding axis, either continuously, or in alternating directions, e.g., for obtaining S-Z type stranding. For example, the direction may be changed whenever the bundle has traversed a distance equal to the storage length in the capstans 55 and 56. The twisted bundle as held by the capstans 55 and 56 is not twisted or stranded further while being so held. This path and storage length for the bundle extends specifically from the point where a bracket of capstan 55 grips the arringing bundle up to the point where a bracket of capstand 56 releases the bundle. This storage length is denoted $l_{sp}$.

The stranded bundle as released by capstan 56 is fed through a wrapping device 57 which wraps a holding and retaining ribbon around the stranded bundle. Moreover, the device 57 may include an extruder, extruding a suitable synthetic around it and into the gaps between the stranded elements to, thereby, embed the stranded elements into an inner core. The wrapping will occur upstream from the extrusion. In addition, the bundle as so jacketed may be suitably marked for identification.

A second stranding point, 58, is established downstream from device 57. This particular stranding point is also a caterpillar-like capstan, except that it does not revolve on the stranding axis. Thus, the bundle receives an additional twist in the space between revolving capstan 56 and nonrevolving capstan 58. Neither extrusion nor ribbon wrapping will interfer with the additional stranding.

The stranded stock is redirected by a sheave 60 and wound onto a drum 61. This is the simplest operation after the stranding. However, additional working steps may be performed on the stranded stock. For example, an armoring may be provided around the stranded bundle, and an outer jacket may be extruded, this jacket to be made of a wear-resistant material such as PVC.

The point in which a bracket of capstan 58 engages the bundle 59 is spaced from the point in which a bracket or capstan 56 releases the bundle by a distance equal to $2nl_r$, wherein n is a positive integer and $l_r$ is the distance the bundle travels in between reversals for stranding in an S-Z pattern. The storage length $l_{sp}$ in the capstan may be equal to that length $l_r$. The total distance chosen, as between capstan 56 and the second stranding point, depends upon particulars of the desired stranding. As stated above, the stranding 59 will have zero waviness, or remains very small, for the following reason.

Figure 5:
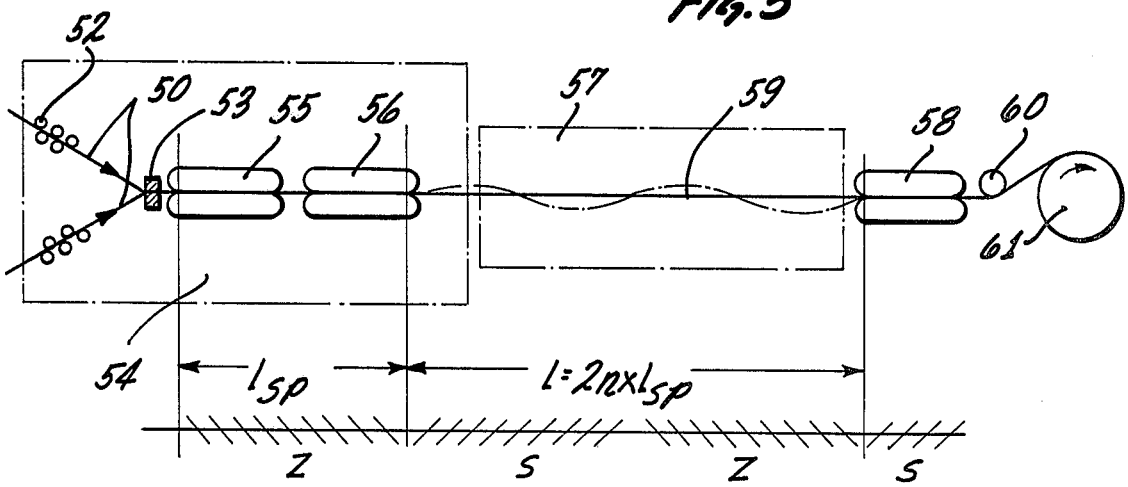
FIG. 5 is a view similar to FIG. 1, but showing details of a further improvement.

In the example of FIG. 5, it is assumed that the first stranding point is placed rather closely to the capstan 55. Moreover, it is assumed that capstans 55 and 56 revolve in one particular direction for the time it takes a bundle increment to traverse the storage path length $L_{sp}$, whereupon the direction of rotation is reversed for a like period. This way, one alternates between S-twists and Z-twists and $l_r = l_{sp}$.

In this specific example, the second stranding point (entrance to capstan 58) is located at a distance from capstan 56 which is equal to twice the reversal length. Thus, in any instance equal quantities of S-twists and Z-twists (i.e., one each) is located in this second stranding path. Mathematically speaking, the total twist on the path from capstan to second stranding point is always zero. The FIG. 1 shows an instant in which the device just about reverses from Z-twist to S-twist. Accordingly, the Z-twist portion that now will gradually enter and pass through the second stranding point (58) will be gradually untwisted, but additional S-twist is imparted upon the S-twist portion. That additional S-twist is removed again from the bundle when and after the direction of revolving the capstans 55 and 56 is again reversed toward producing a Z-twist. As a consequence, the objectional waviness is, in fact, reduced. It was found moreover that waviness is reduced more for still longer lengths, i.e., spacing between revolving capstan and downstream stranding point. However, the spacing must be an even multiple of the distance any bundle increment travels in between reversals.

Figure 6:
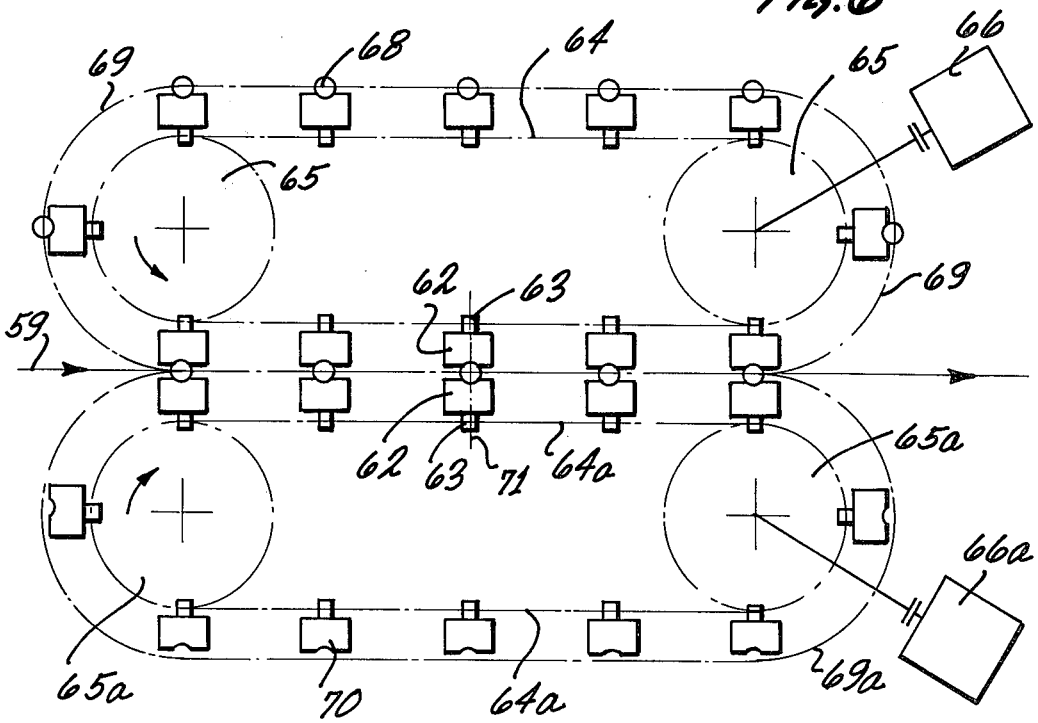
FIG. 6 is a schematic but still more detailed view of an improved example for a capstan that can be used in any of the apparatus' described in the several figures.

FIG. 6 shows one of the capstans, which may be any of the capstans 5, 20, 21, 22, 35, and 36, bearing in mind, however, that in some instance bracket mounts as shown in FIG. 4 should be used to compensate differences in speed of the stock along the propagation path. On the other hand, the speed of the chain drive motors such as 66 and 66*a* could be controlled accordingly. This particular capstan is basically comprised of two chains, 64 and 64*a* respectively looped around pairs of sprockets, 65 and 65*a*. One sprocket in each instance is driven by a drive, 66 and 66*a*, respectively. Bracket and jaw elements 62 are mounted to these chains in a particular distance from each other, but in such a way that these jaw and bracket elements face each other for gripping cooperation of the bundle. The bracket elements have detents 70, and elastic pins 68 are inserted in and affixed to the detents of the bracket elements on chain 64. The pins are preferably made of rigid high-density polyethylene.

The elements 62 are fastened to the chains by means of suitable fasteners 63. These fasteners are centered with respect to pins 68, and vice versa; also, the fasteners on chain 64 are centered to the detents 70 of the respective jaw and bracket elements 62 on that chain. Thus, the pins 68 will engage oppositely located detents in gear-like fashion (see center line 71 in one instance). Also, the centers of the pins 68 run along a particular path 69 which merges with the corresponding path 69*a* of the other chain. Those are the paths of contact of the capstan with the stranded bundle 67 runs in these merging path portions and is positively engaged by the pins 68 and the respective opposing detents 70, matching the pins' contours. Engagement is analogous to holding by a chuck and resemble a gear engagement.

The positive engagement of pins and detents of opposing bracket elements ensures automatically uniformity in the movement of both chains; an equalization gear, or the like, is not needed. Of course, the two drives should be adjusted toward uniform motion as accurately as possible. This arrangement is particularly advantageous in the case of a revolving capstan (55, 56, 35, 36, etc.) as it permits both chain systems of the capstan to have similar mass. Also, the armatures of the two drives 66 and 66*a* can be electrically connected in parallel so that the motors can be controlled, e.g., electronically in a very simple fashion.

The invention is not limited to the embodiments described above; but all changes and modifications thereof, not constituting departures from the spirit and scope of the invention, are intended to be included.

We claim:

1. Apparatus for stranding elongated stock, comprising:

a plurality of stationarily mounted, reelable support spools storing individual strands to be unwound from the spools upon rotation thereof:

means for combining the strands as unwound in a bundle and for providing a first stranding point through which the bundle passes;

means disposed for positively holding the strands of the bundle as a bundle for a particular travel path as the bundle moves along the travel path together and in engagement with the means for holding, said means for holding stranding the strands together about an axis, but outside the travel path between the means for positively holding and the first stranding point, while stranding does not occur on and along the particular travel path due to said positive holding;

means defining a second stranding point through which the stranded bundle passes by operation of rotation as between the means for positively holding and the second stranding point; and means for moving the bundle through the first and second stranding points, the means for holding engaging the bundle as so moved through the travel path without stranding a portion of the bundle while on the travel path due to the positive holding.

2. Apparatus as in claim 1, in which the holding means revolves about said axis.

3. Apparatus as in claim 2, in which said holding means revolves in alternating directions.

4. Apparatus as in claim 2, said means for holding including a plurality of clamping brackets running in axial direction and gripping said bundles over said travel path.

5. Apparatus as in claim 4, the means for holding including pairs of clamping brackets holding the bundle from opposite sides.

6. Apparatus as in claim 5, the brackets being mounted on two endless belt-like carriers.

7. Apparatus as in claim 1, and including means for holding the stranded bundle beyond said second stranding point.

8. Apparatus as in claim 1, and including means for straightening each said strands as unwound, upstream from said means for combining.

9. Apparatus as in claim 1, said means for holding including a pair of caterpillar-like lements with clamping brackets establishing a capstan for holding said bundle over said travel path;

a frame for said capstan journalled for rotation on said axis; and means for driving said frame.

10. Apparatus as in claim 9, said second stranding point being established by a second capstan.

11. Apparatus as in claim 9 or 10, and including a further capstan between said means for combining and said rotating capstan.

12. Apparatus for stranding elongated stock, comprising:

a plurality of spools, storing individual strands to be unwound from the spools;

means for combining the strands, as unwound from the spools, in a bundle and providing a first, relatively nonrotating stranding point;

capstan means; including plural clamping bracket means, each engaging the bundle positively and moving with the bundle for a particular travel path before disengaging from the moving bundle;

means defining a second nonrotating stranding point, said capstan means being disposed between the first and second stranding point;

means for causing the capstan means to rotate to obtain stranding of the bundle as between the first stranding point and a point of engagement of the bundle with one of the clamping means, and to obtain additional stranding as between a point of engagement of the bundle with another one of the clamping means, just prior to release of the bundle by the latter clamping means, and the second stranding point, there being no stranding of a portion of the bundle as between the one clamping means and the other clamping means on account of said positive engaging of the bundle; and means for moving the bundle through the stranding points and the travel path as the bracket means engage the moving bundle.

13. Apparatus as in claim 12, said capstan means including two capstans arranged in series, each defining a portion of the travel path.

14. Apparatus as in claim 13, said capstans rotating in opposite directions to obtain additional stranding of the bundle extending between them.

15. In an apparatus for stranding elongated stock paid individually from spools toward a head combining them into a bundle, there being means for pulling the stock through the head and moving the stock axially, the combination comprising:

a capstan, including a plurality of bracket means being independently driven and provided for engaging individually the bundle as moved by the means for pulling, each bracket means upon engaging the bundle holding the bundle while traveling in positive engagement therewith for a particular travel path, said bracket means disengaging from the bundle as the bundle continues beyond said travel path;

means for rotating the capstan about an axis along the travel path so that a portion of the bundle, as held by some of the bracket means in any instant in positive engagement therewith, is rotated as a whole without being stranded; and means being relatively stationary as far as capstan rotation is concerned and being placed for engagement with the bundle at a point displaced from the capstan so that the bundle is stranded as between the last-mentioned means and the capstan.

16. In an apparatus for stranding elongated stock paid individually from spools, there being means for pulling the stock and moving the stock in axial direction, the combination comprising:

a stationary head, said means for pulling, pulling the stock through the head and combining the stock into a bundle;

a capstan including a pair of bracket means, said bracket means being independently driven for engaging individually the bundle as moved by the means for pulling, each bracket means upon engaging the bundle holding the bundle while traveling in positive engagement therewith for a particular travel path, said bracket means disengaging from the bundle as the bundle continues beyond said travel path;

means for rotating the capstan about an axis along the travel path so that a portion of the bundle, as held by the bracket means, in any instant in positive engagement therewith, is rotated as a whole without being stranded; and said capstan being disposed for said engagement with the bundle at a point displaced from said head so that the bundle is stranded as between the head and the capstan.

17. In an apparatus, as in claim 15, said relatively stationary means being a second capstan which holds the bundle for the length of a travel path and moves therewith, so that stranding occurs as between the two capstans and different portions of the bundle are held by the two capstans.

18. In an apparatus as in claim 15, or 17, including further, relatively stationary means, the two relatively stationary means being placed respectively upstream and downstream to the capstan, to obtain doublestranding action, once upstreamed and additionally downstream from the capstan.

19. Apparatus as in claim 2, 3, or 12, wherein the means for holding or the capstan means includes reversible drive means and control means for the reversible drive means, the second stranding point being spaced from the means for holding or the capstan means by a distance being an even-numbered multiple of the travel path of the bundle in between reversals by the control means.

20. Apparatus as in claim 1 or 12, including means for wrapping around a ribbon, disposed upstream from the second stranding point.

21. Apparatus as in claims 4, 12, 15, or 16, said bracket means being mounted on the two juxtaposed endless driven chains, each of the clamping bracket means including a pair of clamping brackets, one bracket per chain, for gripping the bundle.

22. Apparatus as in claim 21, wherein one of the brackets of a pair has a detent, the other one a matching pin for holding the bundle against the detent.

23. Apparatus as in claim 1 or 12, including means for extruding a filler jacket around and into the stranded bundle, and being disposed upstream from the second stranding point.

* * * * *